US011472210B2

(12) United States Patent
Ishihara et al.

(10) Patent No.: US 11,472,210 B2
(45) Date of Patent: Oct. 18, 2022

(54) COOLING DEVICE AND IMAGE FORMING APPARATUS

(71) Applicant: Ricoh Company, Ltd., Tokyo (JP)

(72) Inventors: Hiroki Ishihara, Kanagawa (JP); Kohki Asada, Tokyo (JP); Kenji Nozawa, Kanagawa (JP); Satoshi Aizawa, Ibaraki (JP)

(73) Assignee: RICOH COMPANY, LTD., Tokyo (JP)

( * ) Notice: Subject to any disclaimer, the term of this patent is extended or adjusted under 35 U.S.C. 154(b) by 350 days.

(21) Appl. No.: 16/778,286

(22) Filed: Jan. 31, 2020

(65) Prior Publication Data

US 2020/0290383 A1 Sep. 17, 2020

(30) Foreign Application Priority Data

Mar. 14, 2019 (JP) ..... JP2019-046958

(51) Int. Cl.
*G03G 15/00* (2006.01)
*B41J 29/00* (2006.01)
(Continued)

(52) U.S. Cl.
CPC ..... *B41J 29/377* (2013.01); *G03G 15/2021* (2013.01); *B65H 2301/5144* (2013.01); *B65H 2406/4212* (2013.01)

(58) Field of Classification Search
CPC ..... G03G 15/2021; G03G 15/2017; G03G 15/6573; G03G 15/6585; G03G 21/206;
(Continued)

(56) References Cited

U.S. PATENT DOCUMENTS

2008/0181688 A1* 7/2008 Kurita ..... G03G 15/2064 399/341
2009/0092427 A1* 4/2009 Goretzky ..... G03G 15/6573 399/341
(Continued)

FOREIGN PATENT DOCUMENTS

JP 2008170539 A * 7/2008
JP 2013-007801 1/2013
(Continued)

*Primary Examiner* — Robert B Beatty
(74) *Attorney, Agent, or Firm* — Xsensus LLP

(57) ABSTRACT

A cooling device includes a cooling member to absorb heat from a conveyed sheet and a plurality of cooling units to cool the cooling member. Each of the cooling units includes a coolant channel through which a coolant flows and a liquid-cooling device configured to cool the coolant that flows in the coolant channel. The coolant channels are disposed on or inside the cooling member and arranged side by side in a sheet conveyance direction. The coolant channels includes a downstream coolant channel being downstream from at least one of the plurality of coolant channels in the sheet conveyance direction, and an upstream coolant channel being upstream from the downstream coolant channel in the sheet conveyance direction. One of the liquid-cooling devices coupled to the downstream coolant channel has a cooling capacity higher than a cooling capacity of another of the liquid-cooling devices coupled to the upstream coolant channel.

18 Claims, 8 Drawing Sheets

(51) Int. Cl.
*B41J 29/377* (2006.01)
*G03G 15/20* (2006.01)

(58) Field of Classification Search
CPC ... G03G 2215/00805; G03G 2215/1645; B41J 29/377; B65H 2301/5144; B65H 2406/4212; B65H 2406/422; B65H 2301/5305; B65H 2515/83; B65H 2801/06
USPC ..... 399/92, 94, 341; 219/216; 347/102, 223
See application file for complete search history.

(56) References Cited

U.S. PATENT DOCUMENTS

2009/0103959 A1* 4/2009 Koyama ..... G03G 15/6573 399/341
2012/0315069 A1* 12/2012 Ikeda ..... G03G 15/0189 399/341
2012/0328344 A1* 12/2012 Kunii ..... G03G 15/6585 399/341
2012/0328346 A1 12/2012 Amita et al.
2013/0004220 A1* 1/2013 Muramatsu ..... G03G 15/2021 399/329
2013/0259512 A1 10/2013 Ikeda et al.
2014/0044462 A1 2/2014 Ikeda et al.
2014/0060782 A1 3/2014 Ikeda et al.
2014/0186080 A1 7/2014 Ikeda et al.
2014/0186081 A1 7/2014 Hirasawa et al.
2014/0212164 A1 7/2014 Miyagawa et al.
2014/0233996 A1 8/2014 Ikeda et al.
2014/0308058 A1 10/2014 Ikeda et al.
2014/0327207 A1 11/2014 Nakagaki
2014/0334858 A1 11/2014 Miyagawa et al.
2015/0010338 A1 1/2015 Miyagawa et al.
2015/0071677 A1 3/2015 Hirasawa et al.
2015/0075207 A1 3/2015 Karikusa et al.
2015/0160610 A1 6/2015 Watanabe et al.
2015/0220030 A1 8/2015 Watanabe et al.
2015/0253699 A1 9/2015 Shimojima et al.
2016/0026125 A1 1/2016 Ishii et al.
2017/0123373 A1* 5/2017 Ogino ..... G03G 21/206
2017/0266987 A1 9/2017 Asada et al.
2017/0266988 A1 9/2017 Asada et al.
2017/0266989 A1 9/2017 Ogawa et al.
2017/0269548 A1 9/2017 Kutsuwada
2017/0334218 A1 11/2017 Ogawa et al.
2018/0016106 A1 1/2018 Asada et al.
2018/0147878 A1 5/2018 Asada et al.
2018/0264852 A1 9/2018 Ohtake et al.

FOREIGN PATENT DOCUMENTS

JP 2013-114094 6/2013
JP 2014-203016 10/2014

* cited by examiner

COOLING DEVICE AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-046958, filed on Mar. 14, 2019, in the Japan Patent Office, the entire disclosure of which is hereby incorporated by reference herein.

BACKGROUND

Technical Field

This disclosure relates to a cooling device and an image forming apparatus incorporating the cooling device.

Related Art

Certain cooling devices include a cooling member that directly or indirectly absorbs heat from a conveyed sheet to cool the sheet and a plurality of cooling units for cooling the cooling member. Each cooling unit includes a channel for a coolant (cooling liquid), disposed in contact with the cooling member, and a liquid-cooling device to cool the coolant. For example, the respective coolant channels are arranged in the direction in which the sheet is conveyed.

SUMMARY

An embodiment of this disclosure provides a cooling device that includes a cooling member to directly or indirectly absorb heat from a conveyed sheet and a plurality of cooling units to cool the cooling member. Each of the cooling units includes a coolant channel through which a coolant flows and a liquid-cooling device to cool the coolant that flows in the coolant channel. The coolant channels are disposed on or inside the cooling member and arranged side by side in a sheet conveyance direction. The coolant channels includes a downstream coolant channel being downstream from at least one of the plurality of coolant channels in the sheet conveyance direction, and an upstream coolant channel being upstream from the downstream coolant channel in the sheet conveyance direction. One of the liquid-cooling devices coupled to the downstream coolant channel has a cooling capacity higher than a cooling capacity of another of the liquid-cooling devices coupled to the upstream coolant channel.

According to another embodiment, one of the liquid-cooling devices coupled to the downstream coolant channel is a heat absorption device configured to absorb, with a refrigerant, heat of the coolant that flows in the downstream coolant channel, and the liquid-cooling devices coupled to the upstream coolant channel is a heat dissipating device configured to dissipate heat of the coolant that flows in the upstream coolant channel.

According to yet another embodiment, one of the liquid-cooling devices coupled to the downstream coolant channel is a chiller, and the liquid-cooling devices coupled to the upstream coolant channel is a radiator.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
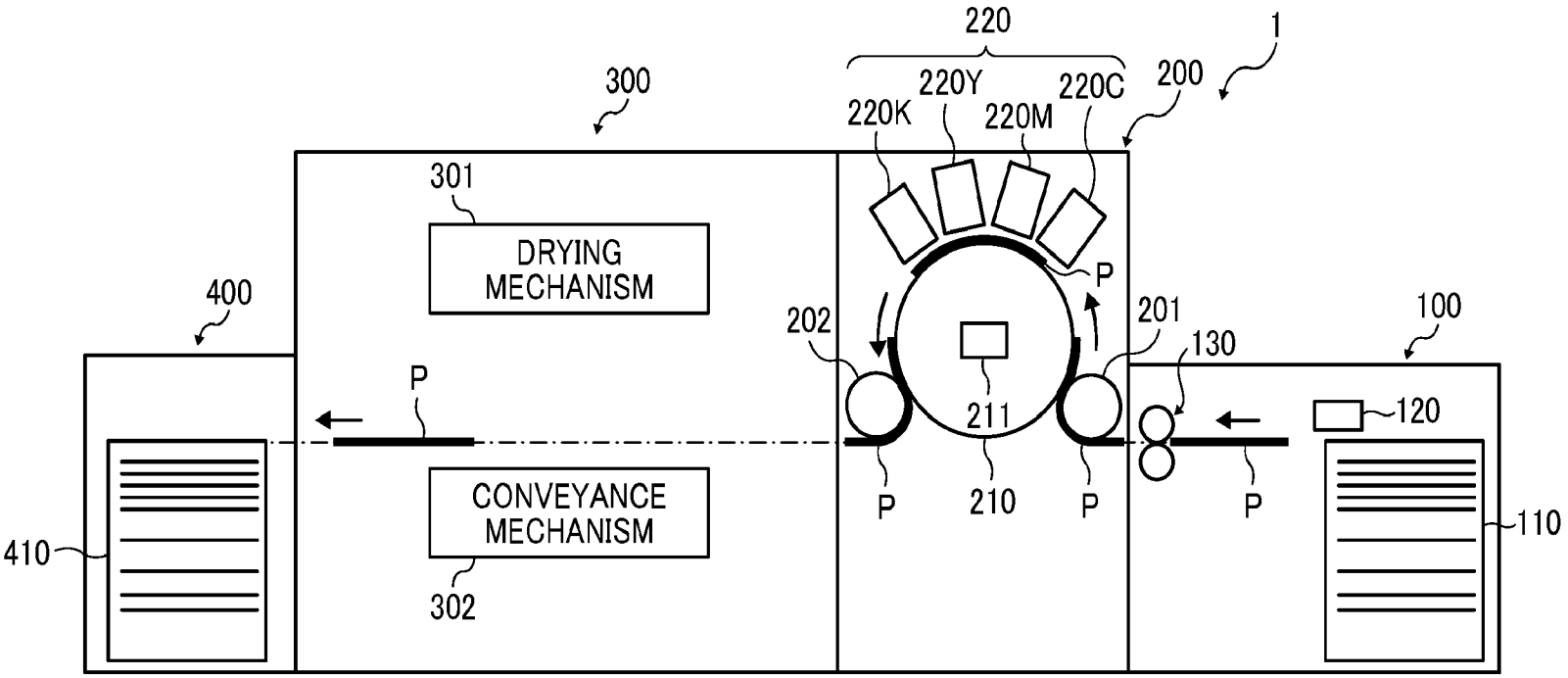
FIG. 1 is a schematic view illustrating a configuration of an inkjet recording apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

Referring now to the drawings, wherein like reference numerals designate identical or corresponding parts throughout the several views thereof, embodiments of this disclosure are described. As used herein, the singular forms "a", "an", and "the" are intended to include the plural forms as well, unless the context clearly indicates otherwise.

FIG. 1 is a schematic view illustrating a configuration of an inkjet recording apparatus according to the present embodiment.

An inkjet recording apparatus 1 according to the present embodiment mainly includes a sheet feeder 100, an image forming unit 200 (an image forming device), a drying unit 300, and a sheet ejection unit 400. In the inkjet recording apparatus 1, the image forming unit 200 forms an image using ink that is an image forming liquid on a sheet P. The sheet P is a recording medium (a sheet material) fed from the sheet feeder 100. The inkjet recording apparatus 1 ejects the sheet P from the sheet ejection unit 400 after the drying unit 300 dries the ink applied onto the paper.

Sheet Feeder

The sheet feeder 100 mainly includes a sheet feeding tray 110, a feeding device 120, and a registration roller pair 130. The sheet feeding tray 110 is for stacking a plurality of sheets P. The feeding device 120 separates and feeds sheets P one by one from the sheet feeding tray 110. The registration roller pair 130 feeds the sheet P to the image forming unit 200. The feeding device 120 can have any sheet feeding configuration, such as that employing a roller or a roll, or that employing air suction. The feeding device 120 sends out the sheet P from the sheet feeding tray 110. After the leading end of the fed sheet P reaches the registration roller pair 130, the registration roller pair 130 is driven at a predetermined timing, to feed the sheet P to the image forming unit 200. In the present embodiment, the configuration of the sheet feeder 100 is not limited to any particular configuration as long as the sheet feeder 100 can feed the sheet P to the image forming unit 200.

Image Forming Unit

The image forming unit 200 mainly includes a transfer cylinder 201, a sheet conveyor drum 210, an ink discharge unit 220, and a transfer cylinder 202. The transfer cylinder 201 receives the sheet P and forwards the sheet P to the sheet conveyor drum 210. The sheet conveyor drum 210 conveys the sheet P fed from the transfer cylinder 201 while bearing the sheet P on the outer peripheral surface thereof. The ink discharge unit 220 discharges ink toward the sheet P on the sheet conveyor drum 210. The transfer cylinder 202 transfers the sheet P conveyed from the sheet conveyor drum 210 to the drying unit 300.

The leading end of the sheet P conveyed from the sheet feeder 100 to the image forming unit 200 is gripped by a sheet gripper provided on the surface of the transfer cylinder 201. The sheet P whose leading end is gripped is conveyed as the transfer cylinder 201 rotates. The sheet conveyed by the transfer cylinder 201 is transferred to the sheet conveyor drum 210 at a position opposite the sheet conveyor drum 210.

A sheet gripper is provided also on the surface of the sheet conveyor drum 210. The sheet gripper of the sheet conveyor drum 210 grips the leading end of the sheet. The sheet conveyor drum 210 includes a plurality of suction holes dispersed on the surface thereof. In each suction hole, a suction device 211 generates a sucking-in airflow orienting inside the sheet conveyor drum 210. When the sheet P is forwarded from the transfer cylinder 201, the leading end thereof is gripped by the sheet gripper on the sheet conveyor drum 210. The sheet is attracted to the surface of the sheet conveyor drum 210 by the sucking-in airflow and conveyed as the sheet conveyor drum 210 rotates.

The ink discharge unit 220 according to the present embodiment discharges four color inks of cyan (C), magenta (M), yellow (Y), and black (K), to form an image. The ink discharge unit 220 includes individual liquid discharge heads 220C, 220M, 220Y, and 220K for each ink. The configurations of the liquid discharge heads 220C, 220M, 220Y, and 220K are not limited to the above-described configurations and can be any other configuration suitable for liquid discharge. The ink discharge unit 220 can include a liquid discharge head that discharges a special ink such as white, gold, or silver as necessary. Further, the ink discharge unit 220 can include a liquid discharge head that discharges a liquid that does not contribute to image formation, such as a surface coating liquid.

The discharge operations of the liquid discharge heads 220C, 220M, 220Y, and 220K of the ink discharge unit 220 are controlled by drive signals corresponding to image data. When the sheet P on the sheet conveyor drum 210 passes through the region opposite the ink discharge unit 220, the ink discharge unit 220 discharges respective color inks from the liquid discharge heads 220C, 220M, 220Y, and 220K. As a result, the ink discharge unit 220 forms an image, on the sheet P, corresponding to the image data. In the present embodiment, the configuration of the image forming unit 200 is not limited to any particular configuration as long as an image is formed by applying liquid onto the sheet P.

Drying Unit

The drying unit 300 mainly includes a drying mechanism 301 and a conveyance mechanism 302. The drying mechanism 301 dries the ink applied to the sheet P by the image forming unit 200. The conveyance mechanism 302 conveys the sheet conveyed from the image forming unit 200. The sheet P conveyed from the image forming unit 200 is received by the conveyance mechanism 302. The conveyance mechanism 302 conveys the received sheet so as to pass through the drying mechanism 301 and forwards the sheet to the sheet ejection unit 400. The drying mechanism 301 dries the ink on the sheet P passing therethrough. As a result, liquid components such as moisture in the ink evaporate. As the moisture in the ink evaporates, the ink is fixed on the sheet P, and curling of the sheet P is suppressed.

Sheet Ejection Unit

The sheet ejection unit 400 includes an output tray 410 for stacking a plurality of sheets. The sheet P conveyed from the drying unit 300 is sequentially stacked and held on the output tray 410. In the present embodiment, the configuration of the sheet ejection unit 400 is not limited to any particular configuration as long as the sheet P is ejected.

The inkjet recording apparatus 1 according to the present embodiment includes the sheet feeder 100, the image forming unit 200, the drying unit 300, and the sheet ejection unit 400, but other units can be added as appropriate. For example, the inkjet recording apparatus 1 can include a pretreatment unit (or a pre-processing unit) between the sheet feeder 100 and the image forming unit 200. The pretreatment unit performs treatment, e.g., of the sheet prior to image formation. In addition, the inkjet recording apparatus 1 can include a post-processing unit between the drying unit 300 and the sheet ejection unit 400. The post-processing unit performs processing after image formation.

For example, the pretreatment unit coats the sheet P with a treatment liquid that reacts with the liquid to inhibit bleeding (a pre-coating process). However, there is no particular limitation on the content of the pretreatment performed by the preprocessing unit. An example of the post-processing unit is a sheet reverse conveyor that reverses and conveys the sheet on which an image is formed by the image forming unit 200, to send the sheet again to the image forming unit 200 to perform image formation on both sides of the sheet. Examples of the post-processing unit further include a mechanism to bind a plurality of sheets on which images are formed, a mechanism to correct deformation of the sheet, and a mechanism to cool the sheet. However, there is no particular limitation on the content of the post-processing performed by the post-processing unit.

In the present embodiment, the inkjet recording apparatus is described as an example of an image forming apparatus. However, the "image forming apparatus" is not limited to an apparatus that includes a liquid discharge head that discharges liquid to a face to be dried of a sheet and visualizes a meaningful image, such as a character or a drawing, with the discharged liquid. For example, the "image forming apparatus" can include an apparatus to form meaningless images, such as meaningless patterns. The material of the sheet material is not limited to a specific material. Examples of the material of the sheet include any materials on which liquid can be adhered even temporarily, such as sheet, thread, fiber, fabric, leather, metal, plastic, glass, wood, and ceramic. For example, the sheet can be made of a material used for film products, cloth products such as clothing, building materials such as wallpaper and flooring, and leather products. The "image forming apparatus" can also include devices to feed, convey, and eject the material onto which liquid adheres. The "image forming apparatus" can further include a pretreatment apparatus to apply treatment liquid to the material before liquid is discharged onto the material and a post-treatment apparatus to apply treatment liquid to the material after liquid is discharged onto the material. Further, "liquid" discharged from the head is not particularly limited as long as the liquid has a viscosity and surface tension of degrees dischargeable from the head. However, preferably, the viscosity of the liquid is not greater than 30 mPa·s under ordinary temperature and ordinary pressure or by heating or cooling. Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as deoxyribonucleic acid (DNA), amino acid, protein, or calcium, or an edible material, such as a natural colorant. These "liquids" can be used, for example, as inkjet ink and surface treatment liquid. The "image forming apparatus" can be an apparatus in which a liquid discharge head and the sheet P move relatively to each other. However, the "image forming apparatus" is not limited to such an apparatus. For example, the image forming apparatus can be a serial head apparatus that moves the liquid discharge head or a line head apparatus that does not move the liquid discharge head.

The term "liquid discharge head" used herein signifies a functional component to discharge or jet liquid from discharge nozzles. For the energy source for generating energy for discharging the liquid, a discharge energy generator such as a piezoelectric actuator, a thermal actuator, and an electrostatic actuator can be used. Examples of the piezoelectric actuator include a laminated piezoelectric element and a thin-film piezoelectric element. The thermal actuator uses an electrothermal transducer element such as a heat element. The electrostatic actuator includes a diaphragm and opposed electrodes. The discharge energy generator to be used is not limited.

In the inkjet recording apparatus 1 according to the present embodiment, the sheet P becomes hot as the drying unit 300 dries the ink adhering to the sheet P. If the hot sheet P is stacked on the output tray 410 as is and left for a long time, the ink layer that has not yet solidified at the time of stacking may adhere to adjacent sheets, causing blocking. Further, in duplex printing, the sheet P that has passed through the drying unit 300 is reversed and sent again to the image forming unit 200, and the image forming unit 200 forms an image on the back side of the hot sheet P. As a result, the liquid discharge heads 220C, 220M, 220Y, and 220K are heated by the heat of the sheet P and become hot, which affects the durability. In view of the foregoing, the inkjet recording apparatus 1 according to the present embodiment includes a cooling device that cools the sheet that has passed through the drying unit 300.

Cooling Device

Figure 2:
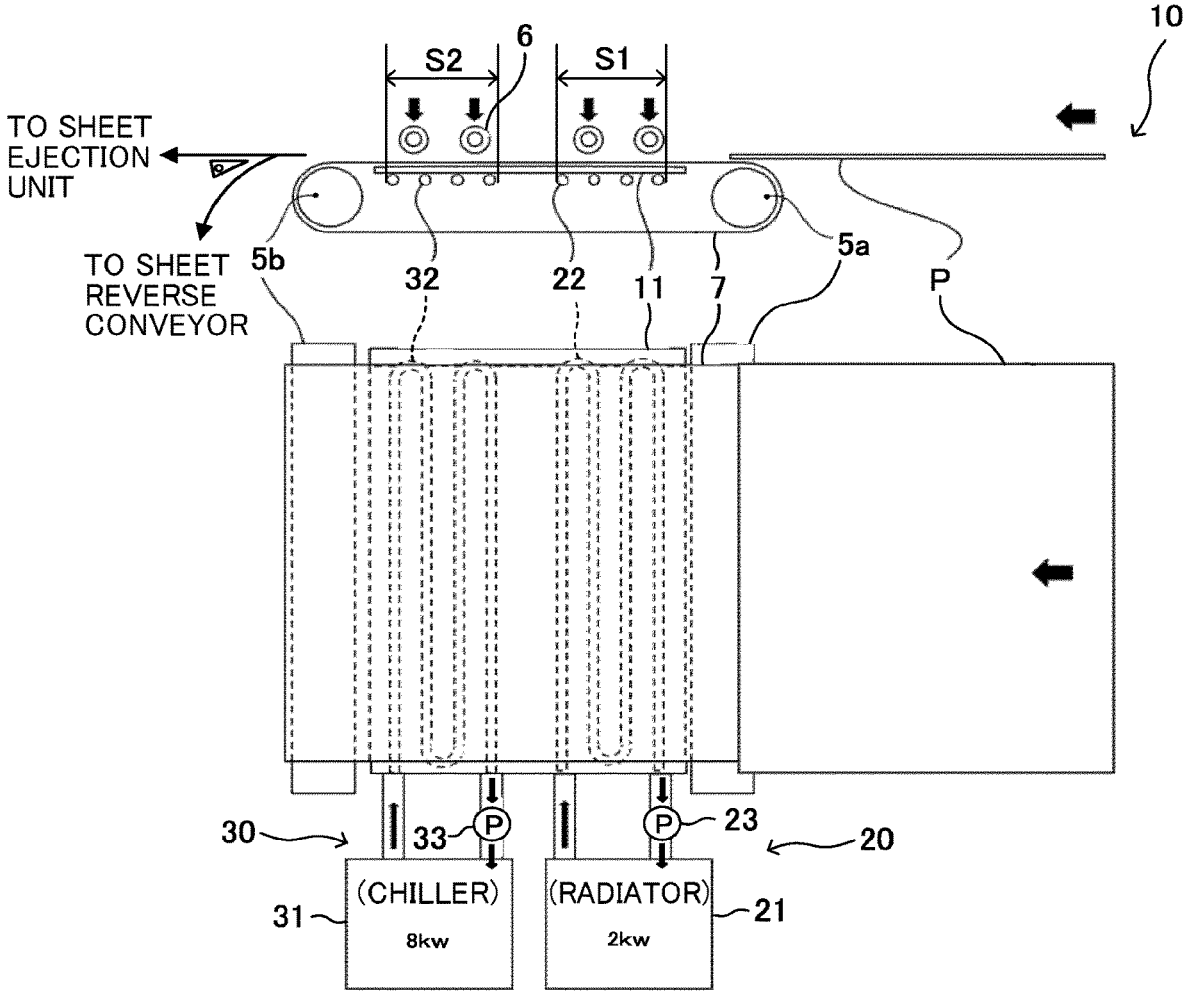
FIG. 2 is a schematic diagram illustrating a configuration of a cooling device according to an embodiment.

FIG. 2 is a schematic diagram illustrating a configuration of a cooling device 10 according to the present embodiment. The cooling device 10 includes a conveyor belt 7, a cooling member 11, a plurality of pressure rollers 6 as pressing members, a first cooling unit 20 as an upstream cooling unit, and a second cooling unit 30 as a downstream cooling unit. The conveyor belt 7 bears the sheet P on the front side and conveys the sheet P. The cooling member 11 absorbs the heat from the sheet P via the conveyor belt 7. The plurality of pressure rollers 6 presses the sheet P against the cooling member 11 via the conveyor belt 7. The first cooling unit 20 and the second cooling unit 30 cool the sheet P.

The conveyor belt 7 is stretched around a plurality of tension rollers 5*a* and 5*b* and rotatable. One of the plurality of tension rollers is a drive roller that rotates, driven by a driving force transmitted from the drive motor. The remaining tension rollers are driven rollers that rotate following the rotation of the conveyor belt 7.

Four pressure rollers 6 are arranged at predetermined intervals in the conveyance direction of the sheet P. Each pressure roller 6 is a driven roller that rotates with of the conveyor belt 7. Each pressure roller 6 is biased toward the conveyor belt 7 by a biasing member such as a spring. Two of the four pressure rollers 6 on the upstream side in the sheet conveyance direction are disposed in a first heat absorption region S1. The two pressure rollers 6 on the downstream side in the sheet conveyance direction are disposed in a second heat absorption region S2. In the first heat absorption region S1, the first cooling unit 20 absorbs the heat from the sheet P via the cooling member 11. In the second heat absorption region S2, the second cooling unit 30 absorbs the heat from the cooling member 11.

The cooling member 11 is disposed inside the loop of the conveyor belt 7 so as to contact the back side of the conveyor belt 7. The cooling member 11 is shaped like a plate and made of aluminum. The first and second cooling units 20 and 30 respectively include first and second coolant pipes 22 and 32, through which a coolant (a refrigerant) flows. The first coolant pipe 22 and the second coolant pipe 32 are in contact with the face (the lower side in FIG. 2) of the cooling member 11 opposite the face (the upper side in FIG. 2) in contact with the back side of the conveyor belt 7.

The first cooling unit 20 includes the first coolant pipe 22 as a coolant channel (flow channel), a first liquid-cooling device 21 as an upstream liquid-cooling device, and a first liquid feed pump 23 as a circulation device. The first coolant pipe 22 is disposed on the cooling member 11, and the coolant flows therein. The first liquid-cooling device 21 cools the coolant flowing through the first coolant pipe 22. The first liquid feed pump 23 circulates and conveys the coolant in the first coolant pipe 22. The first coolant pipe 22 is disposed in an upstream area of the cooling member 11 in the sheet conveyance direction. The first coolant pipe 22 is made of metal (for example, aluminum) having good heat conductivity. The first coolant pipe 22 is fixed to the cooling member 11 by welding or the like. Further, the first coolant pipe 22 is bent in a zigzag manner in the sheet conveyance direction as illustrated in the drawing, in order to increase the contact area with the cooling member 11. Accordingly, the coolant in the pipe flows mainly in the sheet width direction. However, the piping shape of the first coolant pipe 22 is not limited to the shape illustrated in the drawing. Alternatively, for example, the first coolant pipe 22 can be bent in a zigzag manner in the sheet width direction so that the coolant in the pipe flows mainly in the sheet conveyance direction. An inlet of the first coolant pipe 22 into which the coolant flows is coupled to the first liquid-cooling device 21 via a rubber tube. An outlet of the first coolant pipe 22 from which the coolant flows out is coupled to the first liquid feed pump 23 via a rubber tube. The first liquid feed pump 23 is coupled to the first liquid-cooling device 21 via a rubber tube.

The first liquid-cooling device 21 is, for example, a radiator having a cooling capacity of 2 kW. The radiator as a heat dissipating device dissipates heat from the coolant and cools the coolant. The radiator includes a plurality of cooling fins in which flow channels for the coolant are formed. In the radiator, as air contacts the cooling fins due to an airflow inside the apparatus or natural convection, the heat is dissipated from the coolant, to cool the coolant. The radiator further includes a cooling fan to forcibly blow cooling air to a plurality of cooling fins to increase the effect of dissipating the heat of the coolant and enhance the cooling capacity.

The coolant that has exited the radiator flows to the first coolant pipe 22. While flowing through the first coolant pipe 22, the coolant draws out the heat absorbed by the cooling member 111 from the sheet P. Then, the coolant flows from the first coolant pipe 22 to the first liquid feed pump 23. The first liquid feed pump 23 conveys the coolant to the radiator. The radiator dissipates the heat and cools the conveyed coolant. The cooled coolant flows again to the first coolant pipe 22.

The second cooling unit 30 includes a second coolant pipe 32 as a flow channel, a second liquid-cooling device 31 as a downstream liquid-cooling device, and a second liquid feed pump 33 as a circulation device. The second coolant pipe 32 is disposed on the cooling member 11, and the coolant flows therein. The second liquid-cooling device 31 cools the coolant flowing through the second coolant pipe 32. The second liquid feed pump 33 circulates and conveys the coolant in the second coolant pipe 32. The second coolant pipe 32 is disposed in a downstream area of the cooling member 11 in the conveyance direction. The second coolant pipe 32 is made of metal (for example, aluminum) having good heat conductivity. The second coolant pipe 32 is fixed to the cooling member 11 by welding or the like. Similarly to the first coolant pipe 22, the second coolant pipe 32 is bent in a zigzag manner in the sheet conveyance direction as illustrated in the drawing in order to increase the contact area with the cooling member 11. However, the piping shape of the second coolant pipe 32 is not limited to that illustrated in the drawing. Alternatively, for example, the second coolant pipe 32 can be bent in a zigzag manner in the width direction of the conveyor belt 7.

An inlet of the second coolant pipe 32 into which the coolant flows is coupled to the second liquid-cooling device 31 via a rubber tube. An outlet of the second coolant pipe 32 from which the coolant flows out is coupled to the second liquid feed pump 33 via a rubber tube. The second liquid feed pump 33 is coupled to the second liquid-cooling device 31 via a rubber tube.

The second liquid-cooling device 31 is, for example, a chiller having a cooling capacity of 8 kW. The chiller, as a heat absorbing device, absorbs the heat from the coolant with the refrigerant, thereby cooling the coolant. The chiller includes a heat exchanger that performs heat exchange between the coolant and a refrigerant gas such as chlorofluorocarbons. The chiller depressurizes, with an expansion valve, the refrigerant gas to vaporize and conveys the vaporized refrigerant gas to the heat exchanger. The heat exchanger includes a tank to store the coolant. In the heat exchanger, the refrigerant gas flowing in the pipe absorbs the heat of the coolant stored in the tank thereof, to cool the coolant. The refrigerant gas that has absorbed the heat from the coolant is compressed to have a high pressure by a compressor. The high-pressure refrigerant gas compressed by the compressor is cooled by an air-cooling device or a liquid-cooling device. Unlike the radiator, the chiller can cool the coolant equal to or lower than the internal temperature of the apparatus. Further, unlike the radiator, the chiller can easily keep the temperature of the coolant sent to the second coolant pipe 32 at a predetermined temperature by adjusting the amount of discharge of the refrigerant gas with the expansion valve or turning the compressor on and off.

The coolant cooled to the predetermined temperature by the chiller flows to the second coolant pipe 32. While flowing through the second coolant pipe 32, the coolant draws out the heat absorbed by the cooling member 11 from the sheet P. The coolant flows from the second coolant pipe 32 to the second liquid feed pump 33. The second liquid feed pump 33 conveys the coolant to the chiller. The coolant conveyed to the chiller is cooled to a predetermined temperature by heat exchange with the refrigerant of the chiller. The coolant that has cooled to the predetermined temperature flows again into the second coolant pipe 32.

The sheet P, as a cut sheet, heated by the drying unit 300 to a high temperature is conveyed from the drying unit 300 to the cooling device 10. In the cooling device 10, the sheet P is conveyed while being nipped between the conveyor belt 7 and the pressure rollers 6. At this time, the heat of the sheet P is drawn to the cooling member 11 through the conveyor belt 7, and the sheet P is cooled. In the cooling device 10 according to the present embodiment, the pressure rollers 6 press the sheet P against the conveyor belt 7. Therefore, the sheet P is in tight contact with the cooling member 11 through the conveyor belt 7, and the heat of the sheet P is favorably absorbed by the cooling member 11. As a result, the sheet is cooled. Then, the sheet P cooled by the cooling device 10 is conveyed to the sheet ejection unit 400 or the sheet reverse conveyor.

The sheet P conveyed to the sheet ejection unit 400 is stacked on the output tray 410. The sheets P stacked on the output tray 410 are sufficiently cooled by the cooling device 10, and the ink on the sheet P is fully solidified. Therefore, the ink layer can be prevented from sticking to the adjacent sheets, and the occurrence of blocking can be prevented.

The sheet P conveyed to the sheet reverse conveyor is sent again to the image forming unit 200. When the image forming unit 200 forms an image on the back side of the sheet P, the sheet P is sufficiently cooled. Therefore, the liquid discharge heads 220C, 220M, 220Y, and 220K are not heated by the heat of the sheet P. As a result, the durability of the liquid discharge heads 220C, 220M, 220Y, and 220K does not deteriorate.

The heat absorbed by the cooling member 11 from the sheet is absorbed by the coolant flowing in the first coolant pipe 22 and the second coolant pipe 32. Accordingly, the cooling member 11 is cooled. In the cooling units 20 and 30, the coolant heated with the heat drawn from the cooling member 11 is cooled by the liquid-cooling devices 21 and 31 thereof, respectively. Thereafter, the coolant flows again to the coolant pipes 22 and 32.

In the sheet conveyance direction, the first coolant pipe 22 is disposed on the upstream side of the cooling member 11 that draws heat from the sheet and becomes hot. Accordingly, the coolant flowing in the first coolant pipe 22 tends to become hot because of the heat drawn from the upstream portion of the cooling member 11 that has become hot. By contrast, the downstream portion of the cooling member 11 provided with the second coolant pipe 32 disposed on the downstream side in the sheet conveyance direction draws heat from the sheet that has been cooled to some extent by the upstream portion of the cooling member 11. Therefore, the temperature of the downstream portion of the cooling member 11 is lower than that of the upstream portion. Therefore, the coolant flowing in the second coolant pipe 32 draws heat from the downstream portion of the cooling member 11 that is less hot. Therefore, the temperature of the coolant flowing in the second coolant pipe 32 is lower than that of the coolant flowing in the first coolant pipe 22.

Certain cooling devices include a plurality of cooling units having the same configuration and including radiators of the same cooling capacity, as liquid-cooling devices. In such a configuration, the upstream cooling unit including the coolant pipe (coolant channel) disposed on the upstream side in the sheet conveyance direction, the temperature of the coolant is high. Accordingly, the difference between the temperature inside the apparatus and the temperature of the coolant in the upstream cooling unit is large. Therefore, the amount by which the radiator cools the coolant is large. As a result, there is a large difference between the temperature of the coolant flowing into the coolant pipe and the temperature of the coolant flowing out of the coolant pipe. Therefore, the upstream cooling unit can efficiently cool the sheet.

However, the downstream cooling unit including the coolant pipe disposed on the downstream side in the sheet conveyance direction draws heat from the sheet cooled to some extent by the upstream cooling unit. Accordingly, the temperature of the coolant is low, and the difference between the temperature inside the apparatus and the temperature of the coolant is small. Therefore, the amount by which the radiator cools the coolant is small. Therefore, the temperature of the coolant flowing from the radiator into the coolant pipe and the temperature of the downstream portion of the cooling member 11 are not so different. Therefore, the downstream portion of the cooling member 11 is not significantly cooled. As a result, the temperature difference between the downstream portion of the cooling member 11 and the sheet is small. Therefore, cooling of the sheet in the downstream portion of the cooling member 11 may be insufficient.

By contrast, in the cooling device 10 according to the present embodiment, the second liquid-cooling device 31 of the second cooling unit 30, which is the downstream cooling unit including the coolant pipe disposed on the downstream side in the sheet conveyance direction, has a cooling capacity higher than that of the first cooling unit 20, which is the upstream cooling unit. Accordingly, the cooling device 10 according to the present embodiment can increase the amount of cooling of the coolant compared with a comparative structure in which the second liquid-cooling device 31 of the second cooling unit 30 has the same cooling capability as the first liquid-cooling device 21 of the first cooling unit 20. Accordingly, the cooling device 10 according to the present embodiment can increase the difference between the temperature of the cooling member 11 in the second heat absorption region S2 on the downstream side in the sheet conveyance direction and the temperature of the coolant flowing into the second coolant pipe 32 from the second liquid-cooling device 31. As a result, the cooling device 10 according to the present embodiment can cool the cooling member 11 satisfactorily with the coolant. Therefore, the cooling device 10 according to the present embodiment can minimize the temperature rise of the cooling member 11 in the second heat absorption region S2. As a result, the cooling device 10 according to the present embodiment can increase the temperature difference between the second heat absorption region S2 of the cooling member 11 and the sheet P that is in contact with the conveyor belt 7 as compared with the conventional structure. Therefore, the cooling device 10 according to the present embodiment can cool the sheet better in the downstream portion of the cooling member 11 and can cool the sheet better.

Preferably, the second liquid-cooling device 31 that is the downstream liquid-cooling device has a cooling capacity higher, by 4 kW or greater, than the cooling capacity of the first liquid-cooling device 21 that is the upstream liquid-cooling device. When the cooling capacity of the second liquid-cooling device 31 is higher than the cooling capacity of the first liquid-cooling device 21 by 4 kW or greater, a sufficient temperature difference can be secured between the second heat absorption region S2 of the cooling member 11 and the coolant flowing into the second coolant pipe 32. Accordingly, the second heat absorption region S2 of the cooling member 11 is cooled favorably. As a result, the temperature difference between the second heat absorption region S2 of the cooling member and the sheet can be increased, and the sheet is preferably cooled by the second heat absorption region S2 of the cooling member 11.

Furthermore, the cooling device 10 according to the present embodiment uses a chiller as the second liquid-cooling device 31 (heat absorbing device) that absorbs the heat from the coolant with the refrigerant gas, thereby cooling the coolant. The chiller can cool the coolant equal to or lower than the temperature inside the apparatus, unlike a radiator being a heat dissipating device that dissipates the heat of the coolant to cool the coolant. Accordingly, the cooling device 10 according to the present embodiment can increase the temperature difference between the coolant that has passed through the second liquid-cooling device 31 and the second heat absorption region S2 of the cooling member 11. Therefore, the cooling device 10 according to the present embodiment can draw out a significant amount of heat from the cooling member 11. As a result, in the cooling device 10 according to the present embodiment, the temperature difference is sufficient between the second heat absorption region S2 of the cooling member 11 and the sheet P that has been cooled by the first cooling unit 20 to some extent. Therefore, the cooling device 10 according to the present embodiment can draw a significant amount of heat from the sheet in the second heat absorption region S2 and can satisfactorily cool the sheet in the downstream portion of the cooling member 11.

Further, unlike the radiator, the chiller can cool the coolant to a given temperature regardless of the ambient temperature. Accordingly, the cooling device 10 according to the present embodiment can cool the sheet reliably, without being influenced by the ambient temperature.

The sheet P used in the present embodiment is a cut sheet. Therefore, the sheets P may be successively conveyed to the cooling device 10 at regular intervals. However, the cooling device 10 according to the present embodiment can efficiently cool the cooling member 11 with the first cooling unit 20 and the second cooling unit 30. Therefore, the cooling device 10 according to the present embodiment can minimize the temperature rise of the cooling member 11 even when the sheets P are successively conveyed to the cooling device 10 at predetermined intervals. Therefore, the cooling device 10 according to the present embodiment can satisfactorily cool the latter half of the sheets conveyed in successive conveyance.

As the cooling capacity of the liquid-cooling device increases, the cost and the power consumption thereof increase. Therefore, if the cooling capacity of the liquid-cooling device is increased in all the cooling units, the cooling device as a whole is expensive and consumes a large amount of power. By contrast, in the cooling device 10 according to the present embodiment, the first liquid-cooling device 21 uses a radiator that is inexpensive and has a cooling capacity lower than that of the second liquid-cooling device 31 (chiller).

The first heat absorption region S1 (the upstream portion) of the cooling member 11, which is deprived of heat by the first cooling unit 20, contacts via the conveyor belt 7 the sheet having heated by the drying unit 300 to a temperature sufficiently higher than the temperature inside the apparatus. Accordingly, even if the temperature of the first heat absorption region S1 of the cooling member 11 is high to some extent, there is a sufficient temperature difference between the first heat absorption region S1 of the cooling member 11 and the sheet. Therefore, the cooling device 10 according to the present embodiment uses, as the first liquid-cooling device 21, a radiator that is lower in cooling capacity than the chiller. A radiator is inexpensive and consumes less power compared with the chiller. The radiator can cool the coolant only to a temperature somewhat higher than the temperature inside the apparatus, and the first heat absorption region S1 of the cooling member 11 becomes hotter than the temperature inside the apparatus. However, even when the temperature of the first heat absorption region S1 of the cooling member 11 is higher than the temperature inside the apparatus, the first heat absorption region S1 can sufficiently deprive the sheet of heat. Therefore, even when a radiator is used, the temperature of the sheet is satisfactorily lowered by the first cooling unit 20. In addition, the cooling capacity of the radiator greatly depends on the ambient temperature of the radiator. However, the temperature of the coolant is sufficiently higher than the ambient temperature. Therefore, the radiator can maintain a sufficiently high cooling capacity even when the ambient temperature fluctuates somewhat. Thus, since the cooling device 10 according to the present embodiment uses a radiator as the first liquid-cooling device 21, increases in the cost and power consumption of the cooling device 10 are restricted and the sheet can be preferably cooled, compared with the case where the first liquid-cooling device 21 is a chiller similar to the second liquid-cooling device 31.

By contrast, the second heat absorption region S2, which is the downstream portion of the cooling member 11 and deprived of heat by the second cooling unit 30, absorbs the heat from the sheet having cooled in the first heat absorption region S1. Therefore, the temperature rise of the second heat absorption region S2 of the cooling member 11 is small, and the temperature rise of the coolant flowing through the second coolant pipe 32 is small. As a result, the difference between the temperature of the coolant and the ambient temperature of the second liquid-cooling device 31 is not so large. Therefore, when a radiator is used as the second liquid-cooling device 31, the cooling capacity varies greatly depending on the ambient temperature, and cooling of the sheet may be insufficient. Further, the radiator cannot cool the coolant to be equal to or lower than the ambient temperature. As a result, when a radiator is used as the second liquid-cooling device 31, the temperature difference between the cooling member 11 and the coolant is insufficient, and the sheet is not preferably cooled. Therefore, the second liquid-cooling device 31 being a chiller, instead of a radiator, can cool the sheet well even on the downstream side.

Thus, in the cooling device 10 according to the present embodiment, the second liquid-cooling device 31 is a chiller and the first liquid-cooling device 21 is an inexpensive radiator having a cooling capacity lower than that of the second liquid-cooling device 31, which are advantageous in efficiently cooling the sheet while reducing increases in the cost of the device.

Although the cooling device 10 according to the present embodiment uses a chiller as the second liquid-cooling device 31, alternatively, the second liquid-cooling device 31 can be a radiator having a cooling capacity higher than that of the first liquid-cooling device 21. The cooling capacity of the liquid-cooling device can be obtained as the degree by which the temperature of a cooling target (cooling member) has decreased under a predetermined ambient temperature during a specified time.

Next, variations of the cooling device 10 are described below.

Figure 3:
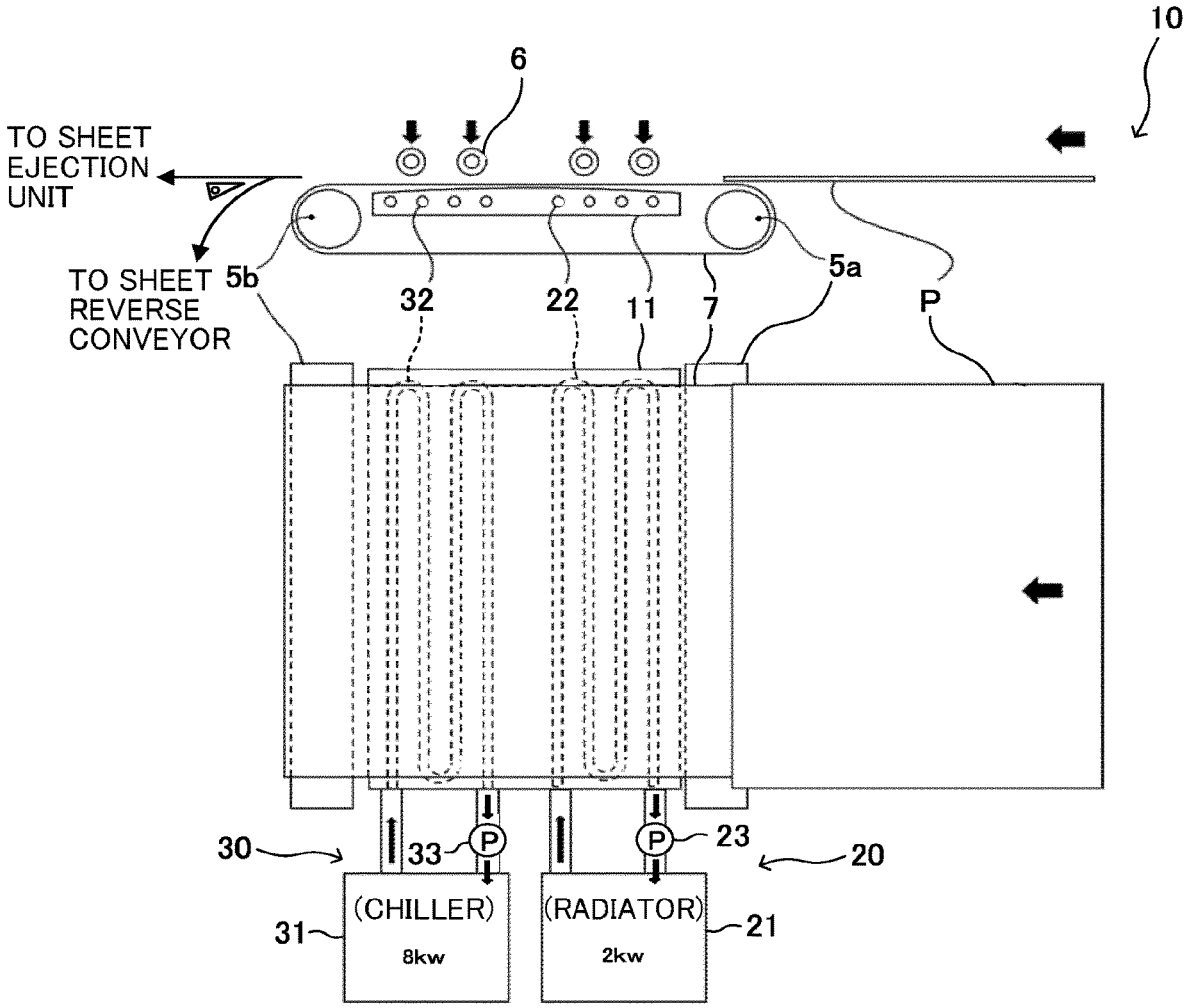
FIG. 3 is a schematic diagram of a cooling device according to Variation 1.

FIG. 3 is a schematic diagram of a cooling device according to Variation 1. In the cooling device 10 according to Variation 1, the first coolant pipe 22 of the first cooling unit 20 and the second coolant pipe 32 of the second cooling unit 30 are inside the cooling member 11. The coolant flows in the first and second coolant pipes 22 and 32. Such a structure can increase the contact area between the cooling member 11 and the coolant pipes 22 and 32. Therefore, the cooling device 10 according to Variation 1 can efficiently transfer the heat of the sheet absorbed by the cooling member 11 to the coolant.

Figure 4:
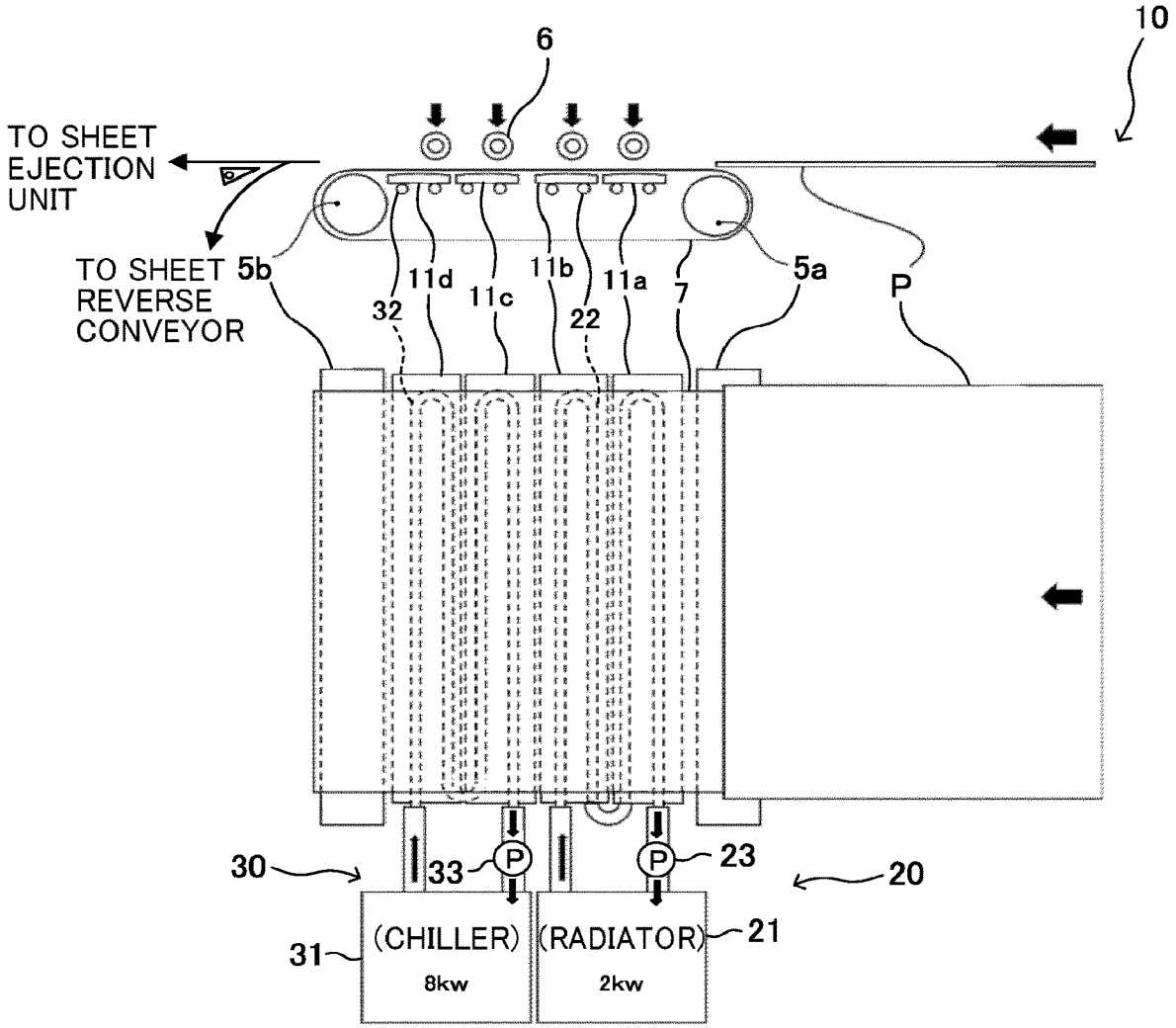
FIG. 4 is a schematic diagram of a cooling device according to Variation 2.

FIG. 4 is a schematic diagram of a cooling device according to Variation 2. In the cooling device 10 according to Variation 2, four cooling members 11*a* to 11*d* are arranged side by side in the sheet conveyance direction. The first coolant pipe 22 of the first cooling unit 20 is in contact with the two cooling members 11*a* and 11*b* on the upstream side in the sheet conveyance direction. The second coolant pipe 32 of the second cooling unit 30 is in contact with the two cooling members 11*c* and 11*d* on the downstream side in the sheet conveyance direction.

Figure 5:
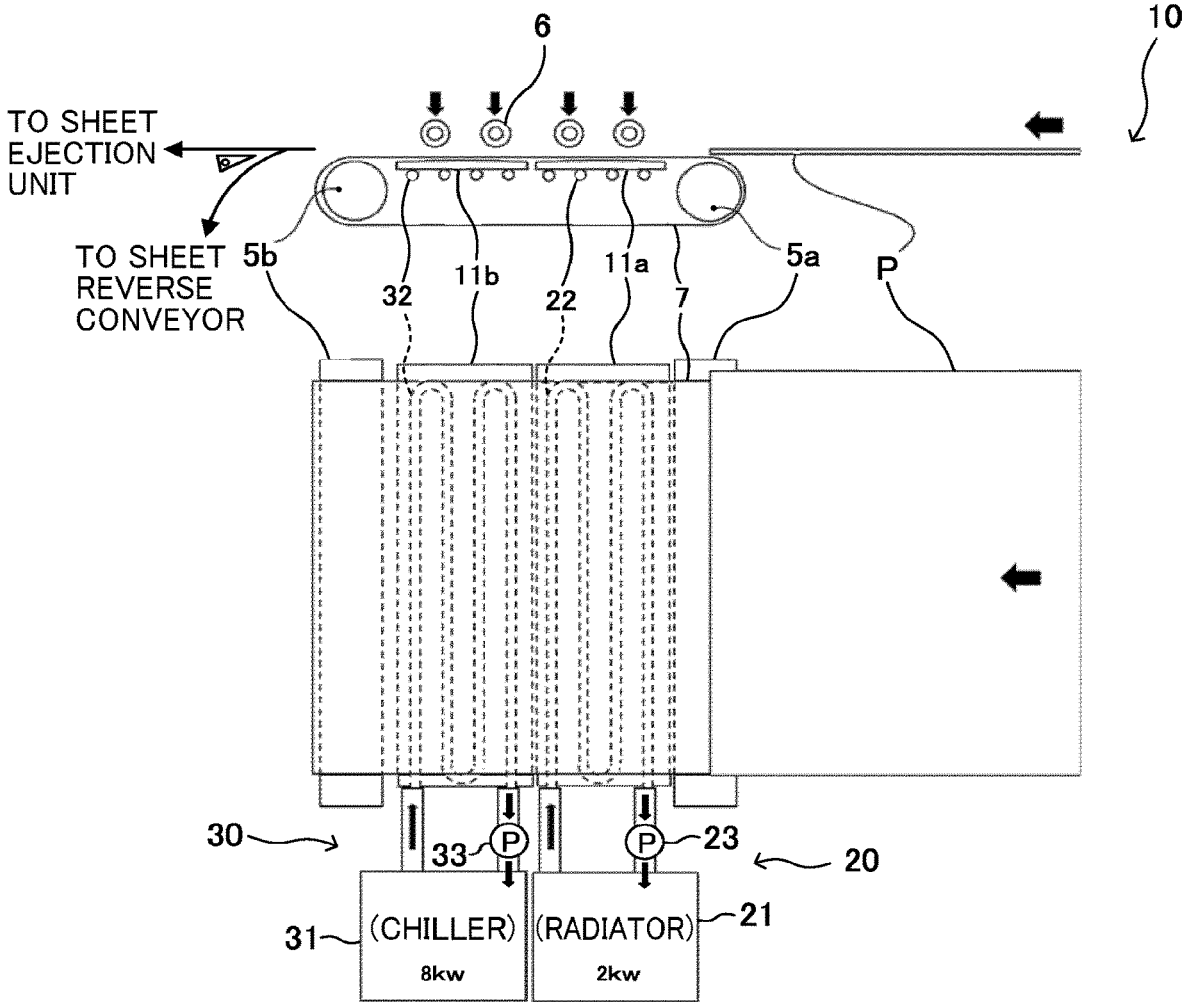
FIG. 5 is a schematic diagram illustrating another example of the cooling device according to Variation 2.

FIG. 5 is a schematic diagram illustrating another example of the cooling device 10 according to Variation 2. The cooling device 10 according to Variation 2 illustrated in FIG. 5 includes two cooling members 11*a* and 11*b* arranged side by side in the sheet conveyance direction. The first coolant pipe 22 of the first cooling unit 20 is in contact with the upstream cooling member 11*a*. The second coolant pipe 32 of the second cooling unit 30 is in contact with the downstream cooling member 11*b*.

As illustrated in FIGS. 4 and 5, the cooling device 10 according to Variation 2 can improve the degree of freedom of layout by using a plurality of cooling members 11. More specifically, when the plurality of the cooling members 11 is used, for example, a configuration such as Variation 3 (a configuration illustrated in FIG. 6) described later can be possible. Thus, the degree of freedom of component layout is improved.

Figure 6:
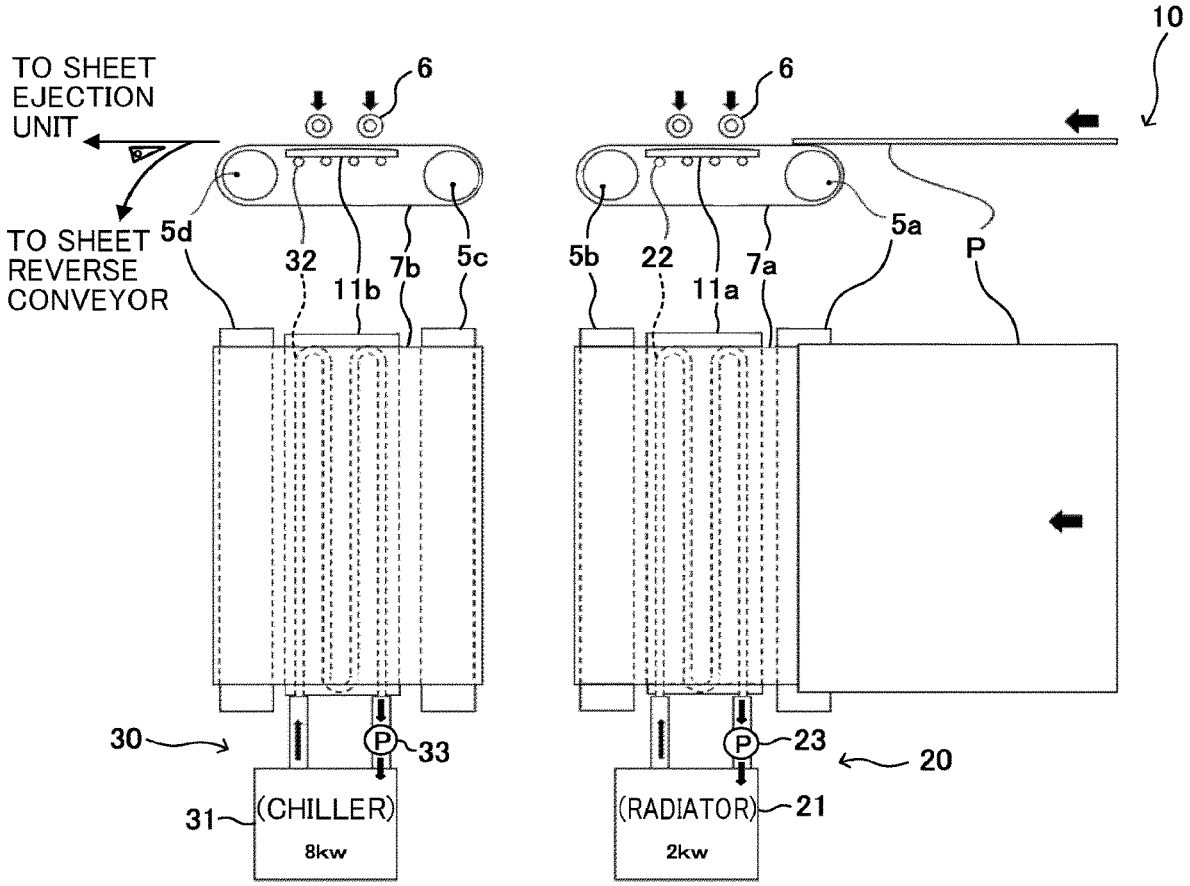
FIG. 6 is a schematic diagram of a cooling device according to Variation 3.

FIG. 6 is a schematic diagram of the cooling device according to Variation 3. The cooling device 10 according to Variation 3 includes a first conveyor belt 7*a* and a second conveyor belt 7*b*, and the cooling members 11*a* and 11*b* are disposed inside the loops of the conveyor belts 7*a* and 7*b*, respectively. The first coolant pipe 22 is in contact with the cooling member 11*a* disposed on (the back side of) the first conveyor belt 7*a*. The second coolant pipe 32 is in contact with the cooling member 11*b* disposed on (the back side of) the second conveyor belt 7*b*. In Variation 3, there are two conveyor belts, but three or more conveyor belts can be provided. Although the coolant pipes correspond to the respective conveyor belts in Variation 3, alternatively, for example, one conveyor belt can be provided with coolant pipes of a plurality of cooling units. Moreover, Variation 3 can be modified such that one of a plurality of conveyor belts is without a cooling member or a coolant pipe. Thus, the cooling device 10 according to Variation 3 can improve the degree of freedom of component layout by using a plurality of conveyor belts.

Figure 7:
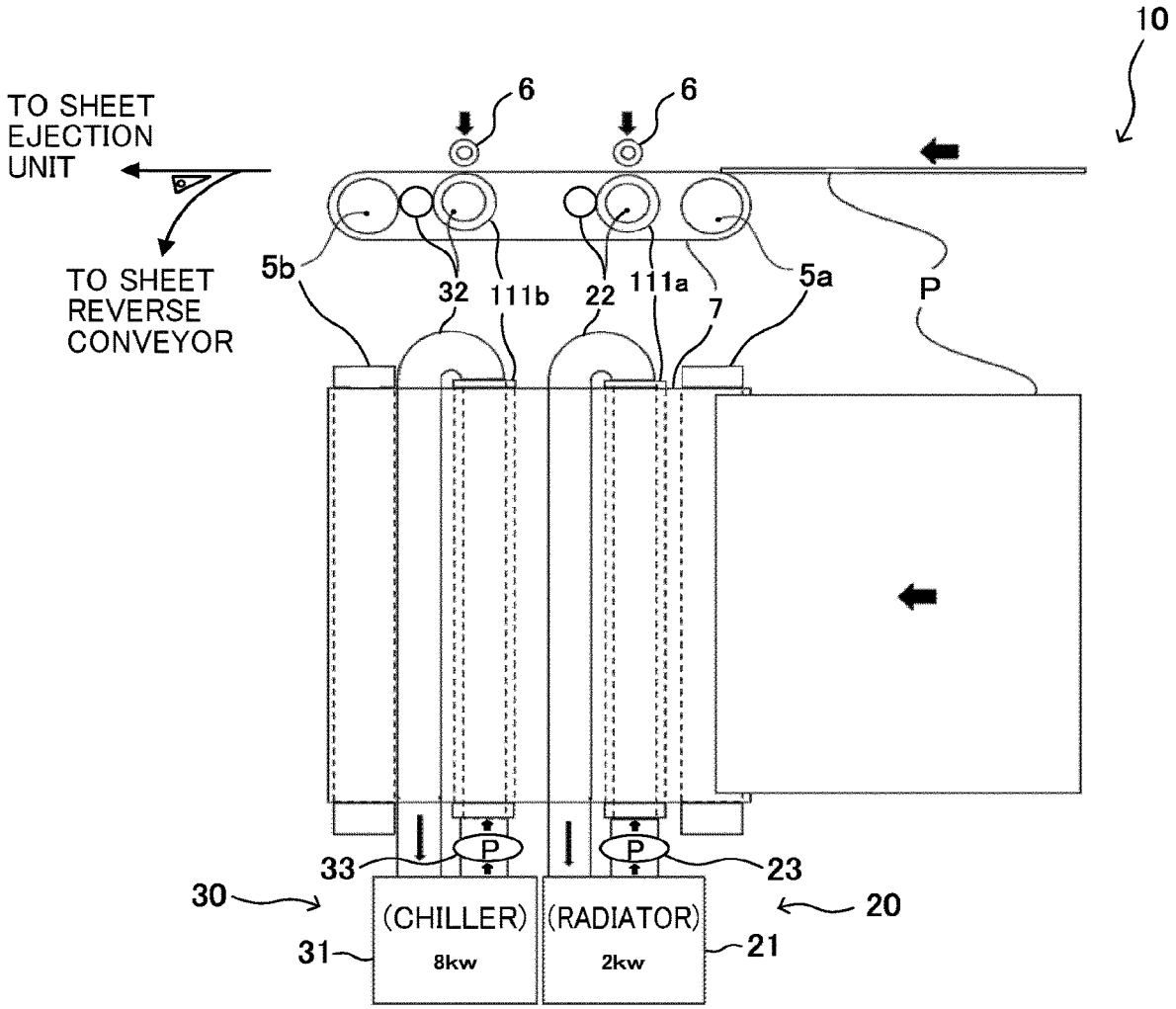
FIG. 7 is a schematic diagram of a cooling device according to Variation 4.

FIG. 7 is a schematic diagram of a cooling device according to Variation 4. In the cooling device 10 according to Variation 4, the cooling member is a roller that is rotatably supported by the coolant pipe. A first cooling roller 111*a* disposed on the upstream side in the sheet conveyance direction is rotatably supported by the first coolant pipe 22. The second cooling roller 111*b* disposed on the downstream side in the sheet conveyance direction is rotatably supported by the second coolant pipe 32. Further, the cooling device 10 according to Variation 4 includes two pressure rollers 6. One of the pressure rollers 6 is in contact with the first cooling roller 111*a* via the conveyor belt 7. The other pressure roller 6 is in contact with the second cooling roller 111*b* via the conveyor belt 7.

When the cooling member is the cooling roller, the sliding resistance (friction) between the conveyor belt 7 and the cooling member can be reduced. Accordingly, the cooling device 10 according to Variation 4 can inhibit wear of the conveyor belt 7. Further, the cooling device 10 according to Variation 4 can reduce the driving torque in driving the conveyor belt 7.

Further, in the cooling device 10 according to Variation 4, the cooling roller rotatably supported by the coolant pipe can be in contact with the front surface of the conveyor belt 7, so that the front side (print side) of the sheet P is cooled by the cooling roller. Even in such a configuration, since the cooling roller rotates with the front side of the sheet P, the image formed on the front side of the sheet P is not disturbed.

Figure 8:
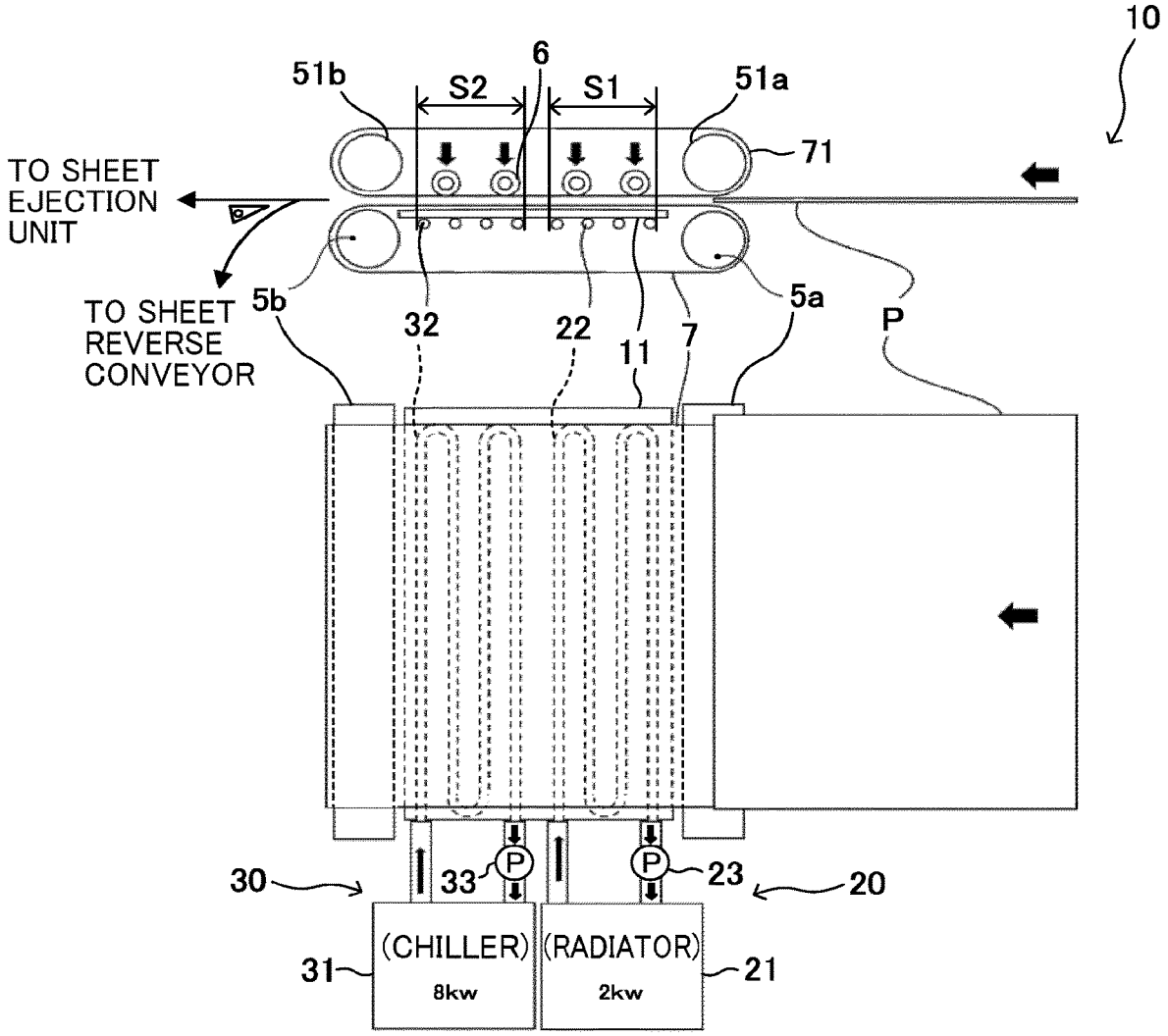
FIG. 8 is a schematic diagram of a cooling device according to Variation 5.

FIG. 8 is a schematic diagram of a cooling device according to Variation 5. The cooling device 10 according to Variation 5 includes an upper conveyor belt 71 and conveys the sheet P while sandwiching the sheet P between the conveyor belt 7 and the upper conveyor belt 71. As illustrated in FIG. 8, the upper conveyor belt 71 is stretched between two tension rollers 51*a* and 51*b*. Four pressure rollers 6 are disposed inside the loop of the upper conveyor belt 71. The two tension rollers 51*a* and 51*b* can be driven rollers, and the upper conveyor belt 71 can be rotated by rotation of the conveyor belt 7. Alternatively, one of the two tension rollers 51*a* and 51*b* can be a drive roller that is rotated by a driving force transmitted from a drive motor, and the upper conveyor belt 71 can be thereby driven.

The cooling device 10 according to Variation 5 can reliably convey the sheet P by sandwiching the sheet P between the conveyor belt 7 and the upper conveyor belt 71. Further, in the cooling device 10 according to Variation 5, the upper conveyor belt 71 can press the sheet P against the cooling member 11 even between the pressure rollers 6. Thus, the upper conveyor belt 71 can function as a pressing member. As a result, in the cooling device 10 according to Variation 5, the sheet P can be reliably in contact with the cooling member 11 via the conveyor belt 7. Therefore, the cooling device 10 according to Variation 5 can absorb the heat from the sheet P satisfactorily by the cooling member 11.

Further, the cooling device 10 of Variation 5 can have the following configuration to cool the sheet from both sides. That is, a cooling member is also disposed inside the loop of the upper conveyor belt 71, and the coolant pipe of the first cooling unit or the second cooling unit is disposed in contact with the cooling member inside the loop of the upper conveyor belt 71. Further, the cooling device 10 according to Variation 5 can include a third cooling unit, and a coolant pipe of the third cooling unit can be in contact with the cooling member disposed inside the loop of the upper conveyor belt 71.

The above description concerns the cooling devices in which the coolant pipes of the two cooling units are arranged side by side in the sheet conveyance direction. However, the cooling device can include three or more cooling units, and three or more coolant pipes can be arranged side by side in the sheet conveyance direction. A requisite for the cooling device is as follows. At least extreme downstream one of a plurality of cooling units provided with an extreme downstream coolant pipe is higher in liquid-cooling capacity than at least one of the plurality of cooling units provided with a coolant pipe positioned upstream from the extreme downstream coolant pipe. In this way, the sheet P can be preferably cooled by the cooling device in which the cooling capacity of the liquid-cooling device of at least extreme downstream cooling unit is higher than the cooling capacity of the liquid-cooling device of one of the plurality of cooling units on the upstream side. Further, the liquid-cooling device of at least extreme downstream cooling unit (including the extreme downstream coolant pipe) is a chiller, and the liquid-cooling device of at least extreme upstream cooling unit (including the extreme upstream coolant pipe) is a radiator. Accordingly, the cooling device can efficiently cool the sheet while inhibiting increases in the cost of the device.

The above description concerns application of aspects of the present disclosure to the cooling device that cools the sheet that has passed through the drying unit 300. However, aspects of the present disclosure can be applied to a cooling device that cools a sheet heated by a fixing device in an electrophotographic image forming apparatus.

The structures described above are just examples, and various aspects of the present disclosure can provide, for example, the following effects, respectively.

Aspect 1

A cooling device, such as the cooling device 10, includes a cooling member, such as the cooling member 11, that directly or indirectly absorbs heat from a conveyed sheet and cools the sheet and a plurality of cooling units. Each of the cooling units includes a coolant channel, such as the coolant pipes 22 and 32, through which a coolant flows, disposed on or inside the cooling member, and a liquid-cooling device, such as the liquid-cooling devices 21 and 31, to cool the coolant. At least respective coolant channels of the plurality of cooling units are arranged side by side in a sheet conveyance direction. The liquid-cooling device of one of the plurality of cooling units positioned downstream from at least one of the rest of the cooling units is referred to as a downstream liquid-cooling device, and one of the coolant channels of the plurality of cooling units cooled by the downstream liquid-cooling device is referred to as a downstream coolant channel. The downstream liquid-cooling device, such as the second liquid-cooling device 31, that cools the coolant flowing in the downstream coolant channel, such as the second coolant pipe 32, is higher in cooling capacity than an upstream liquid-cooling device, such as the first liquid-cooling device 21, that cools the coolant flowing in an upstream coolant channel, such as the first coolant pipe 22, disposed upstream from the downstream coolant channel in the sheet conveyance direction. There are cooling devices in which a plurality of cooling units employs, as liquid-cooling devices, radiators having the same configuration and the same cooling capacity. The coolant flowing through the coolant channel disposed on the upstream side in the sheet conveyance direction absorbs the heat from the cooling member heated by the heat absorbed from the high-temperature sheet immediately after passing through the heating device (such as a fixing device) to heat the sheet. Accordingly, the temperature of the coolant rises. Therefore, the temperature difference between the coolant and the ambient temperature increases, and the cooling amount of the radiator cooling the coolant increases. By contrast, the coolant flowing through the coolant channel disposed downstream in the sheet conveyance direction absorbs heat from the downstream cooling member that absorbs heat from the sheet that has been cooled by the upstream cooling member to some extent. Accordingly, the temperature of the coolant on the downstream side is not so high. As a result, the temperature difference between the coolant and the ambient temperature is small, and the cooling amount of the radiator cooling the coolant is small. As a result, the temperature difference between the cooling member and the coolant is small, and the coolant does not sufficiently cool the cooling member. Then, the cooling amount of the sheet by the downstream cooling member is reduced, and cooling of the sheet may be insufficient. By contrast, according to Aspect 1, the cooling capacity of the downstream liquid-cooling device to cool the coolant flowing in the coolant channel disposed on the downstream side in the sheet conveyance direction is higher than that of the upstream liquid-cooling device to cool the coolant flowing in the coolant channel disposed on the upstream side in the sheet conveyance direction. Thus, the cooling capacity of the downstream liquid-cooling device for cooling the coolant can increase compared with a comparative structure in which the downstream liquid-cooling device is the same in cooling capacity as the upstream liquid-cooling device. As a result, the temperature difference between the cooling member and the coolant can be increased and the cooling member can be better cooled. Accordingly, compared with the comparative structure, a sheet can be cooled more favorably also on the downstream side in the sheet conveyance direction. Thus, the sheet can be cooled favorably.

Aspect 2

In Aspect 1, the cooling capacity of the downstream liquid-cooling device, such as the second liquid-cooling device 31, is higher by 4 kW or greater than the cooling capacity of the upstream liquid-cooling device, such as the first liquid-cooling device 21. Accordingly, as described in the embodiment, the coolant flowing in the coolant channel such as the second coolant pipe 32 disposed on the downstream side can be cooled well. Thus, the sheet can be cooled preferably on the downstream side.

Aspect 3

In Aspect 1 or 2, the downstream liquid-cooling device, such as the second liquid-cooling device 31, is a heat absorption device, such as a chiller, that absorbs the heat of the coolant with a refrigerant, thereby cooling the coolant. Accordingly, as described in the embodiment, the cooling capacity is less affected by the ambient temperature, the coolant can be cooled, as intended, to a temperature equal to or lower than the internal temperature of the apparatus. As a result, the temperature difference between the cooling member and the coolant can be reliably increased, and the sheet can be satisfactorily cooled on the downstream side.

Aspect 4

In any one of Aspects 1 to 3, the upstream liquid-cooling device, such as the first liquid-cooling device 21, is a heat dissipating device such as a radiator that dissipates the heat of the coolant, to cool the coolant. Accordingly, as explained in the embodiment, the cost of the apparatus can be reduced as compared with the case where the upstream liquid-cooling device, such as the first liquid-cooling device 21, is a heat absorption device such as a chiller. In addition, power consumption can be reduced. In addition, the coolant flowing through the coolant channel such as the first coolant pipe 22 disposed on the upstream side absorbs heat from the hot cooling member that has drawn heat from the hot sheet, and the temperature of the coolant is sufficiently higher than the ambient temperature. Therefore, even when an inexpensive and low power consumption radiator is used as the upstream liquid-cooling device, the heat of the coolant can be dissipated well, and the coolant can be cooled well.

Aspect 5

A cooling device, such as the cooling device 10, includes a cooling member, such as the cooling member 11, that directly or indirectly absorbs heat from a conveyed sheet and cools the sheet and a plurality of cooling units. Each of the cooling units includes a coolant channel, such as the coolant pipes 22 and 32, through which a coolant flows, disposed on or inside the cooling member, and a liquid-cooling device, such as the liquid-cooling devices 21 and 31, to cool the coolant. At least respective coolant channels of the plurality of cooling units are arranged side by side in a sheet conveyance direction. The liquid-cooling device of one of the plurality of cooling units positioned downstream from at least one of the rest of the cooling units is referred to as a downstream liquid-cooling device, and one of the coolant channels of the plurality of cooling units cooled by the downstream liquid-cooling device is referred to as a downstream coolant channel. The downstream liquid-cooling device, such as the second liquid-cooling device 31, that cools the coolant flowing in the downstream coolant channel, such as the second coolant pipe 32, is a heat absorption device, such as a chiller, that absorbs the heat of the coolant with a refrigerant, thereby cooling the coolant. The upstream liquid-cooling device, such as the first liquid-cooling device 21, that cools the coolant flowing in the upstream coolant channel, such as the first coolant pipe 22, is a heat dissipating device such as a radiator that dissipates heat of the coolant, thereby cooling the coolant. Accordingly, as explained in the embodiment, when the upstream liquid-cooling device (e.g., the first liquid-cooling device 21) is a heat dissipating device such as a radiator, the cost can be reduced as compared with the case where the upstream liquid-cooling device, such as the first liquid-cooling device 21, is a heat absorption device such as a chiller. In addition, the coolant flowing through the upstream coolant channel such as the first coolant pipe 22 absorbs heat from the hot cooling member that is heated, with the heat drawn from the hot sheet, to a temperature sufficiently higher than the ambient temperature. Accordingly, the temperature of the coolant having cooled the cooling member is also sufficiently higher than room temperature. Therefore, the temperature of the coolant can be sufficiently lowered even when the liquid-cooling device is a heat dissipating device. Even when the coolant is not cooled to a temperature lower than room temperature, the temperature difference between the cooling member and the coolant can be sufficiently large, and the cooling member can be cooled preferably. Further, when the downstream liquid-cooling device, such as the second liquid-cooling device 31, is a heat absorption device such as a chiller, the coolant can be cooled to or lower than room temperature. As a result, a sufficient temperature difference can be secured between the sheet and the coolant, which has been cooled nearly to the temperature inside the apparatus by the cooling member on the upstream side. Then, the sheet can be satisfactorily cooled even on the downstream side. Accordingly, the sheet can be cooled satisfactorily while limiting increases in cost of the device.

Aspect 6

A cooling device, such as the cooling device 10, includes a cooling member, such as the cooling member 11, that directly or indirectly absorbs heat from a conveyed sheet and cools the sheet and a plurality of cooling units. Each of the cooling units includes a coolant channel, such as the coolant pipes 22 and 32, through which a coolant flows, disposed on or inside the cooling member, and a liquid-cooling device, such as the liquid-cooling devices 21 and 31, to cool the coolant. At least respective coolant channels of the plurality of cooling units are arranged side by side in a sheet conveyance direction. The liquid-cooling device of one of the plurality of cooling units positioned downstream from at least one of the rest of the cooling units is referred to as a downstream liquid-cooling device, and one of the coolant channels of the plurality of cooling units cooled by the downstream liquid-cooling device is referred to as a downstream coolant channel. The downstream liquid-cooling device, such as the second liquid-cooling device 31, that cools the coolant flowing in the downstream coolant channel, such as the second coolant pipe 32, is a chiller. The upstream liquid-cooling device, such as the first liquid-cooling device 21, that cools the coolant flowing in the upstream coolant channel, such as the first coolant pipe 22, is a radiator. Accordingly, as explained in the embodiment, when the upstream liquid-cooling device (e.g., the first liquid-cooling device 21) is a heat dissipating device such as a radiator, the cost can be reduced as compared with the case where the upstream liquid-cooling device, such as the first liquid-cooling device 21, is a chiller. In addition, the coolant flowing through the upstream coolant channel such as the first coolant pipe 22 absorbs heat from the hot cooling member that is heated, with the heat drawn from the hot sheet, to a temperature sufficiently higher than the ambient temperature. Accordingly, the temperature of the coolant having cooled the cooling member is also sufficiently higher than room temperature. Therefore, the temperature of the coolant can be sufficiently lowered even when the liquid-cooling device is a radiator. Even when the coolant is not cooled to a temperature lower than room temperature, the temperature difference between the cooling member and the coolant can be sufficiently large, and the cooling member can be cooled preferably. Further, when the downstream liquid-cooling device, such as the second liquid-cooling device 31, is a chiller, the coolant can be cooled equal to or lower than room temperature. As a result, a sufficient temperature difference can be secured between the sheet and the coolant, which has been cooled nearly to the temperature inside the apparatus by the cooling member on the upstream side. Then, the sheet can be satisfactorily cooled even on the downstream side. Accordingly, the sheet can be cooled satisfactorily while limiting increases in cost of the device.

Aspect 7

In any one of Aspects 1 to 6, each cooling unit includes a circulation device, such as liquid feed pumps 23 and 33, that circulates the coolant between the coolant channel and the liquid-cooling device.

Aspect 8

The cooling device according to any one of Aspects 1 to 7 further includes a pressing member, such as the pressure roller 6, that presses the sheet, such as the sheet P, against the cooling member, such as the cooling member 11, via a conveyor belt, such as the conveyor belt 7. Accordingly, as described in the embodiment, the sheet such as the sheet P can be in tight contact with the cooling member 11 via the conveyor belt 7, and the heat of the sheet can be favorably transferred to the cooling member.

Aspect 9

In Aspect 8, the pressing member is a belt such as the upper conveyor belt 71 having a sheet conveyance capability. Accordingly, as described in Variation 5, the sheet such as the sheet P can be reliably conveyed, and the sheet can be in tight contact with the cooling member 11 via the conveyor belt 7.

Aspect 10

In any one of Aspects 1 to 9, the coolant channels such as the coolant pipes 22 and 32 are inside the cooling member 11. Accordingly, as explained in Variation 1, the contact area between the cooling member 11 and the heat absorbing portions such as the coolant pipes 22 and 32 can be increased, and the heat of the cooling member is absorbed favorably by the heat absorbing portions.

Aspect 11

In any one of Aspects 1 to 10, a plurality of cooling members (e.g., the cooling members 11*a* to 11*d*) is disposed side by side in the sheet conveyance direction. Accordingly, as described in Variation 2, the degree of freedom of component layout improves.

Aspect 12

In Aspect 11, the coolant channel (e.g., the coolant pipes 22 and 32) of at least one of the plurality of cooling units is disposed on or inside the plurality of cooling members. Accordingly, as described in Variation 2, the degree of freedom of component layout improves. In addition, the number of components can be reduced and the cost of the device can be reduced compared with a configuration in which two or greater cooling units are provided for each cooling member.

Aspect 13

In Aspect 11 or 12, the cooling members are respectively disposed on a plurality of conveyor belts (e.g., the conveyor belts 7*a* and 7*b*) that convey a sheet such as the sheet P. Accordingly, as described using Variation 3, the degree of freedom of component layout can improve.

Aspect 14

In any one of Aspects 1 to 13, the cooling member 11 is a roller. Accordingly, as explained in Variation 4, sliding resistance with the conveyor belt 7 can be suppressed, and wear of the conveyor belt 7 can be suppressed.

Aspect 15 In any one of Aspects 1 to 14, the sheet is a cut sheet. Accordingly, as described in the embodiment, even when the cut sheets are successively conveyed at regular intervals, the sheets can be efficiently and satisfactorily cooled.

Aspect 16

An image forming apparatus, such as the inkjet recording apparatus 1, includes an image forming device that forms an image on a sheet such as the sheet P and a cooling device (e.g., the cooling device 10) according to any one of Aspects 1 to 15, to cool the sheet. As described in the embodiment, this aspect can prevent the blocking of the sheet P stacked on the output tray 410. Further, when an image is formed on the back side of the sheet, the image forming device can be prevented from becoming hot, and deterioration of durability of the image forming device can be inhibited.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure.

What is claimed is:

1. A device comprising:

a head to output liquid ink on a sheet;

a dryer to dry the liquid ink on the sheet;

a cooler to directly or indirectly absorb heat from the sheet which has ink and is received from the dryer to cool the sheet; and a plurality of cooling units respectively including:

a plurality of coolant channels through which a coolant flows, the plurality of coolant channels disposed on or inside the cooler and arranged side by side in a sheet conveyance direction; and a plurality of liquid coolers to cool the coolant that flows in the plurality of coolant channels, respectively, the plurality of coolant channels including:

a downstream coolant channel being downstream from at least one of the plurality of coolant channels in the sheet conveyance direction; and an upstream coolant channel being upstream from the downstream coolant channel in the sheet conveyance direction, the plurality of liquid coolers including a downstream liquid cooler coupled to the downstream coolant channel, the downstream liquid cooler having a cooling capacity higher than a cooling capacity of an upstream liquid cooler being one of the plurality of liquid coolers coupled to the upstream coolant channel.

2. The device according to claim 1, wherein the cooling capacity of the downstream liquid cooler is higher by 4 kW or greater than the cooling capacity of the upstream liquid cooler.

3. The cooling device according to claim 1, wherein the downstream liquid cooler is a heat absorber to absorb heat of the coolant with a refrigerant to cool the coolant.

4. The cooling device according to claim 1, wherein the upstream liquid cooler is a heat dissipator to dissipate heat of the coolant to cool the coolant.

5. The device according to claim 1, wherein each of the plurality of cooling units further includes a circulator to circulate the coolant between the coolant channels and the liquid coolers.

6. The device according to claim 1, further comprising:

a conveyor belt to convey the sheet; and a press to press the sheet against the cooler via the conveyor belt.

7. The device according to claim 6, wherein the press is a belt having a sheet conveyance capability.

8. The device according to claim 1, wherein the plurality of coolant channels is inside the cooler.

9. The device according to claim 1, further comprising a plurality of coolers including the cooler, the plurality of coolers being side by side in the sheet conveyance direction.

10. The device according to claim 9, wherein the coolant channel of at least one of the plurality of cooling units extends over at least two of the plurality of coolers.

11. The device according to claim 9, further comprising a plurality of conveyor belts to convey the sheet, wherein the plurality of coolers is disposed on the plurality of conveyor belts, respectively.

12. The device according to claim 1, wherein the cooler is a roller.

13. The device according to claim 1, wherein the sheet is a cut sheet.

14. An image forming apparatus comprising:

a printer, including the head and the dryer, to form an image on the sheet; and the device according to claim 1, to cool the sheet.

15. A device comprising:

a head to output liquid ink on a sheet;

a dryer to dry the liquid ink on the sheet;

a cooler to directly or indirectly absorb heat from the sheet which has ink and is received from the dryer to cool the sheet; and a plurality of cooling units respectively including:

a plurality of coolant channels through which a coolant flows, the plurality of coolant channels disposed on or inside the cooler and arranged side by side in a sheet conveyance direction; and a plurality of liquid coolers to cool the coolant that flows in the plurality of coolant channels, respectively, the plurality of coolant channels including:

a downstream coolant channel being downstream from at least one of the plurality of coolant channels in the sheet conveyance direction; and an upstream coolant channel being upstream from the downstream coolant channel in the sheet conveyance direction, the plurality of liquid coolers including:

a heat device coupled to the downstream coolant channel and to absorb, with a refrigerant, heat of the coolant that flows in the downstream coolant channel; and a heat dissipater coupled to the upstream coolant channel and configured to dissipate heat of the coolant that flows in the upstream coolant channel.

16. A cooling device comprising:

a head to output liquid ink on a sheet;

a dryer to dry the liquid ink on the sheet;

a cooler to directly or indirectly absorb heat from the sheet which has ink and is received from the dryer to cool the sheet; and a plurality of cooling units respectively including:

a plurality of coolant channels through which a coolant flows, the plurality of coolant channels disposed on or inside the cooler and arranged side by side in a sheet conveyance direction; and a plurality of liquid coolers to cool the coolant that flows in the plurality of coolant channels, respectively, the plurality of coolant channels including:

a downstream coolant channel being downstream from at least one of the plurality of coolant channels in the sheet conveyance direction; and an upstream coolant channel being upstream from the downstream coolant channel in the sheet conveyance direction, the plurality of liquid coolers including:

a chiller coupled to the downstream coolant channel and to cool the coolant that flows in the downstream coolant channel; and a radiator coupled to the upstream coolant channel and to cool the coolant that flows in the upstream coolant channel.

17. The device according to claim 15, wherein:

the upstream coolant channel which is coupled to the heat dissipator does not use any type of active chilling device, and the downstream coolant channel which is coupled to the heat absorber includes a chiller.

18. The device according to claim 16, wherein:

the upstream coolant channel which is coupled to the radiator does not use any type of active chilling device.

* * * * *